United States Patent [19]

Maternaghan

[11] 4,184,878

[45] Jan. 22, 1980

[54] PROCESS FOR THE MANUFACTURE OF PHOTOGRAPHIC SILVER HALIDE EMULSIONS CONTAINING SILVER HALIDE CRYSTALS OF THE TWINNED TYPE

[75] Inventor: Trevor J. Maternaghan, Brentwood, England

[73] Assignee: Ciba-Geigy Aktiengesellschaft, Basel, Switzerland

[21] Appl. No.: 965,378

[22] Filed: Nov. 30, 1978

Related U.S. Application Data

[63] Continuation-in-part of Ser. No. 799,040, May 20, 1977, Pat. No. 4,150,994.

[30] Foreign Application Priority Data

Jun. 10, 1976 [GB] United Kingdom ..... 24001/76
May 25, 1978 [GB] United Kingdom ..... 22728/78

[51] Int. Cl.[2] ..... G03C 1/02; G03C 1/28

[52] U.S. Cl. ..... 430/567; 430/569; 430/598; 430/603; 430/604; 430/605

[58] Field of Search ..... 96/94 R, 108

[56] References Cited

U.S. PATENT DOCUMENTS

| | | | |
|---|---|---|---|
| 2,592,250 | 5/1952 | Davey et al. | 96/94 R |
| 3,482,982 | 12/1969 | Michata | 96/94 R |
| 3,573,057 | 3/1957 | Stevens | 96/94 R X |
| 3,655,394 | 4/1972 | Illingsworth | 96/108 |
| 3,773,516 | 11/1973 | Gutoff | 96/94 R |
| 3,782,954 | 1/1974 | Porter et al. | 96/94 R |
| 3,790,387 | 2/1977 | Munslinger | 96/94 R |
| 3,821,002 | 6/1974 | Culhane et al. | 96/94 R |
| 3,917,485 | 11/1975 | Morgan | 96/94 R |
| 3,957,490 | 5/1976 | Libeer et al. | 96/94 R |
| 4,150,994 | 4/1979 | Maternaghan | 96/94 R |

FOREIGN PATENT DOCUMENTS

| | | | |
|---|---|---|---|
| 1335925 | 10/1973 | United Kingdom | 96/94 R |
| 1469480 | 4/1977 | United Kingdom | 96/94 R |

*Primary Examiner*—Edward C. Kimlin
*Attorney, Agent, or Firm*—Sprung, Felfe, Horn, Lynch & Kramer

[57] ABSTRACT

A method of preparing photograhic silver iodide, containing emulsions is provided. The silver halide crystals in said emulsions are of the twinned type and the method comprises the steps of (a) forming in a colloid dispersing medium silver halide crystals containing at least 90 mole % iodide, these said crystals being predominantly of the hexagonal lattice structure and then chemically sensitizing the said silver halide crystals which contain at least 90 mole % iodide, (b) mixing in the dispersing medium containing the said silver halide crystals an aqueous solution of a silver salt and an aqueous solution of an alkali metal or ammonium bromide or chloride or mixtures thereof so forming twinned silver halide crystals containing iodide and the halide or halides being added, (c) adding a silver halide solvent to the dispersing medium and so causing the growth of the twinned crystals by Ostwald ripening, optionally (d) causing the twinned crystals to increase in size by adding to the colloidal dispersion further aqueous silver salt solution and further alkali metal or ammonium halide and then finally optionally (e) removing the water-soluble salts formed and chemically sensitizing the surface of the silver halide crystals of the emulsion.

The new photographic emulsions exhibit a high internal sensitivity and covering power and contrast on development.

21 Claims, 3 Drawing Figures

Hexagonal lattice silver iodide
Epitaxial Growth
Cubic lattice silver iodobromide
Iodide content
100 %
45 %
30 %
25 %

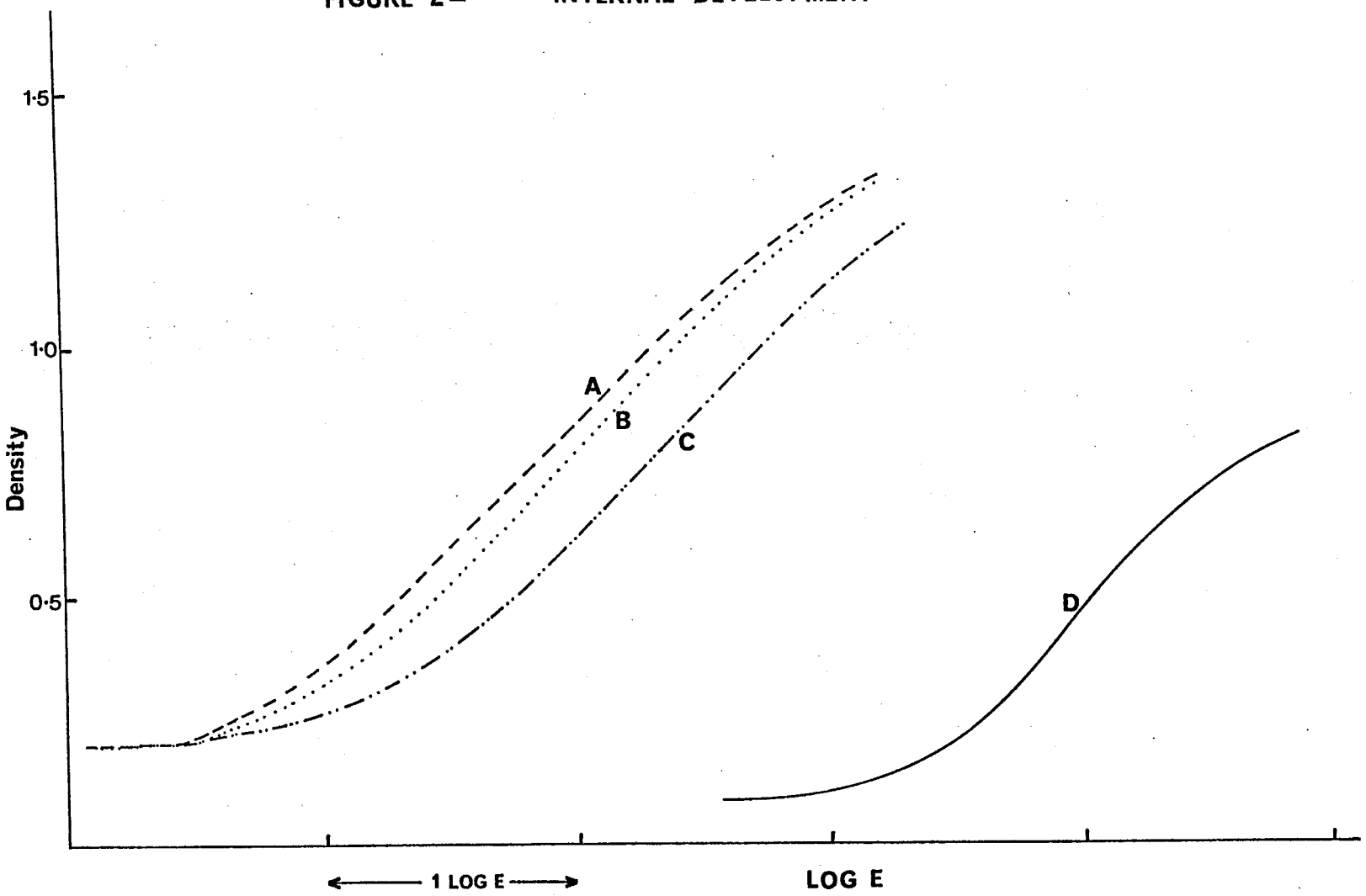
FIGURE 2 – INTERNAL DEVELOPMENT

FIGURE 3 – FOGGING DEVELOPMENT
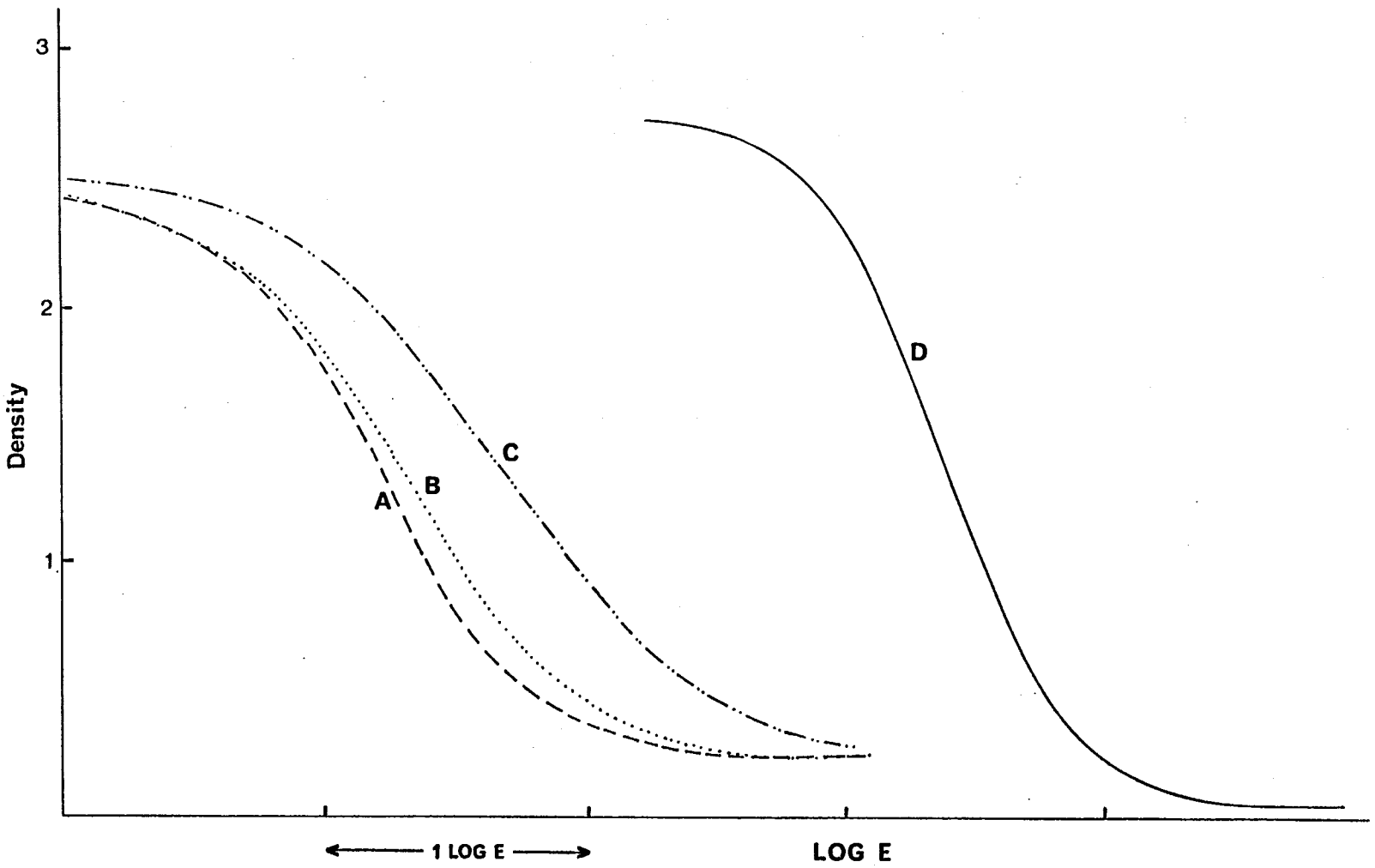

PROCESS FOR THE MANUFACTURE OF PHOTOGRAPHIC SILVER HALIDE EMULSIONS CONTAINING SILVER HALIDE CRYSTALS OF THE TWINNED TYPE

CROSS-REFERENCE TO RELATED PATENT APPLICATION

This application is a continuation-in-part of U.S. application Ser. No. 799,040, filed May 20, 1977, now U.S. Pat. No. 4,150,994.

BACKGROUND OF THE INVENTION

This invention relates to improved photographic silver halide emulsions, and to a process for the production of such emulsions.

Silver halide emulsions are composed of silver halide crystals dispersed in a colloid medium which is often gelatin. The properties of the photographic emulsions depend very markedly on the several steps which are used to prepare the photographic emulsion, and the relation and order of one or more of such steps with respect to each of the others.

Thus, a common process for preparation of such an emulsion comprises the initial precipitation (nucleation) of microscopic silver halide crystals, usually by mixing of a silver salt solution with a water-soluble halide salt solution; growth of these crystals by further addition of reagent solutions; washing of the emulsion to remove water-soluble salts formed as a by-product of the double-decomposition reaction of the previous precipitation stages, and sensitisation in order to increase the intrinsic sensitivity of the final emulsion by treatment with chemical sensitising agents such as sulphur and gold salts, and in many cases by the addition of spectral sensitising dyes.

The steps of such an emulsion-making process can be designed precisely to meet various desirable objectives so that emulsions having the requisite photographic properties may be obtained. Thus, the precipitation stages in the process may be adapted to control the average size of the silver halide crystals (which in general determines the speed of the photographic emulsion), the size distribution of those crystals (which affects photographic contrast), the shape and habit of the crystals (including the external lattice faces and the extent of twinning) and the halide composition of the crystals. It is particularly advantageous to control the uniformity of the halide distribution within the population of crystals, and the halide compositional profile within each crystal. The shape and internal structure of the crystals have also an important influence on the photographic behaviour of the emulsion. In particular twinned silver halide crystals are favored in many applications, because of their high photographic sensitivity and covering power (ratio of developed density to weight of developed silver).

This invention relates especially to silver halide crystals which are of particular shape and habit. However in order to achieve this selection of shape and habit it has been found necessary that some restriction of the halide composition is also required. Specifically, this invention relates to an improved method for the production of silver iodobromide, silver iodochloride or silver iodochlorobromide emulsions of the twinned type by a controlled incorporation of silver iodide in the silver halide crystals during growth.

Improved photographic properties are often observed when a mixture of water-soluble halides is used in the precipitation of the silver halide. In general there are two recognised techniques for controlling the precipitation of silver halide, as described by Gutoff in U.S. Pat. No. 3,773,516; the single-jet and the double-jet emulsification methods. In the single-jet process aqueous silver nitrate solution is added to a solution containing a small amount of gelatin and a mixture of soluble halides. The crystal size distribution may be controlled by an Ostwald ripening step after part or all of the silver nitrate has been introduced, in which the emulsion is held at elevated temperatures in the presence of a silver halide solvent. During this step the least soluble, large crystals grow by diffusion and incorporation of silver halide dissolved from the more soluble, small crystals.

The ripening stage results in an increase in average crystal size of the emulsion (and often an increase in the photographic sensitivity of the emulsion ultimately) and a widening of the crystal size distribution. The crystal habit of photographic emulsions made by a single-jet technique often is predominantly that of twinned octahedral crystals, due to the large excess of halide ions present during the precipitation and ripening stages. This is especially true of iodobromide precipitations. A description of twinned crystals is given in "An Introduction to Crystallography", 3rd edition, Longmans (1966) pp. 162–165 by F. C. Phillips and "The Crystalline State", by P. Gay, Oliver and Boyd (1972) pp. 328–338. The disadvantage of such a single-jet process is that the twinned crystals produced invariably have a relatively wide size distribution. In the alternative double-jet process, aqueous solutions of silver nitrate and soluble halide salts are added simultaneously to a stirred solution of gelatin. The flow rates of the reagent solutions may be regulated so that the quantity of excess halide is maintained constant, and predominantly untwinned crystals are formed.

Silver halide crystals of flat or tabular shape exhibit on development extremely good covering power and thus the silver utilisation is extremely good compared with silver halide crystals of other shapes for example cubic crystals. Many twinned octahedral crystals are of this type particularly if the crystals contain more than one twin-plane and the twin planes are parallel. A particular object of the present invention is to increase the proportion of twinned crystals with parallel twin planes in an emulsion.

Another objective of improvements in the commercial production of photographic emulsions is to increase the contrast of the final material, this being a desirable property for graphic arts and radiographic products. This may be achieved partly as a result of a decrease in size distribution, as for example described in British patent specification No. 1,469,480, and partly by ensuring that the iodide content and iodide distribution of different silver halide crystals in the emulsion are made more similar. The point of addition of the soluble iodide salt in various emulsification processes is known to affect the sensitivity and size distribution of the emulsion (Research Disclosure No. 13,452 (1975)).

Thus the application of photographic emulsions containing twinned crystals to products requiring enhanced sensitivity and contrast has been hindered by the defects in conventional emulsification procedures particularly the uncontrolled incorporation of iodide in the crystals. There was described in copending in U.S. Pat. Application Ser. No. 799,040, filed May 20, 1977, now U.S. Pat.

No. 4,150,994, an improved method for the preparation of silver iodobromide, silver iodochloride or silver iodochlorobromide photographic emulsions, wherein iodide ions are supplied to the growing crystals by the dissolution of a uniform dispersion of silver iodide crystals. There was also described the conditions under which the desired tabular twinned habit is favoured by this process, and by which substantially uniform photographic emulsion crystals of this type may be prepared.

Thus there is described in said copending application a method of preparing a silver halide emulsion of the twinned type which comprises the steps of (a) forming in a colloid dispersing medium silver halide crystals containing at least 90 mole % iodide, (b) mixing in the dispersing medium containing the said silver halide crystals an aqueous solution of a silver salt and an aqueous solution of an alkali metal or ammonium bromide or chloride or mixtures thereof so forming twinned silver halide crystals containing iodide and the halide or halides being added, (c) adding a silver halide solvent to the dispersing medium and so causing the growth of the twinned crystals by Ostwald ripening, optionally (d) causing the twinned crystals to increase in size by adding to the colloidal dispersing further aqueous silver salt solution and further alkali metall or ammonium halide and then finally optionally (e) removing the water-soluble salts formed and chemically sensitising the emulsion.

It has now been discovered that the process as just described can be modified by chemically sensitising the silver halide crystals containing at least 90 mole % iodide in step (a).

SUMMARY OF THE INVENTION

Therefore according to the present invention there is provided a method of preparing a silver halide emulsion of the twinned type which comprises the steps of (a) forming in a colloid dispersing medium silver halide crystals containing at least 90 mole % iodide, these said crystals being predominantly of the hexagonal lattice structure and then chemically sensitising the said silver halide crystals which contain at least 90 mole % iodide, (b) mixing in the dispersing medium containing the said silver halide crystals an aqueous solution of a silver salt and an aqueous solution of an alkali metal or ammonium bromide or chloride or mixtures thereof so forming twinned silver halide crystals containing iodide and the halide or halides being added, (c) adding a silver halide solvent to the dispersing medium and so causing the growth of the twinned crystals by Ostwald ripening, optionally (d) causing the twinned crystals to increase in size by adding to the colloidal dispersion further aqueous silver salt solution and further alkali metal or ammonium halide and then finally optionally (e) removing the water-soluble salts formed and chemically sensitising the surface of the silver halide crystals of the emulsion.

DETAILED DESCRIPTION OF THE INVENTION

Figures 1A, 1B, 1C:
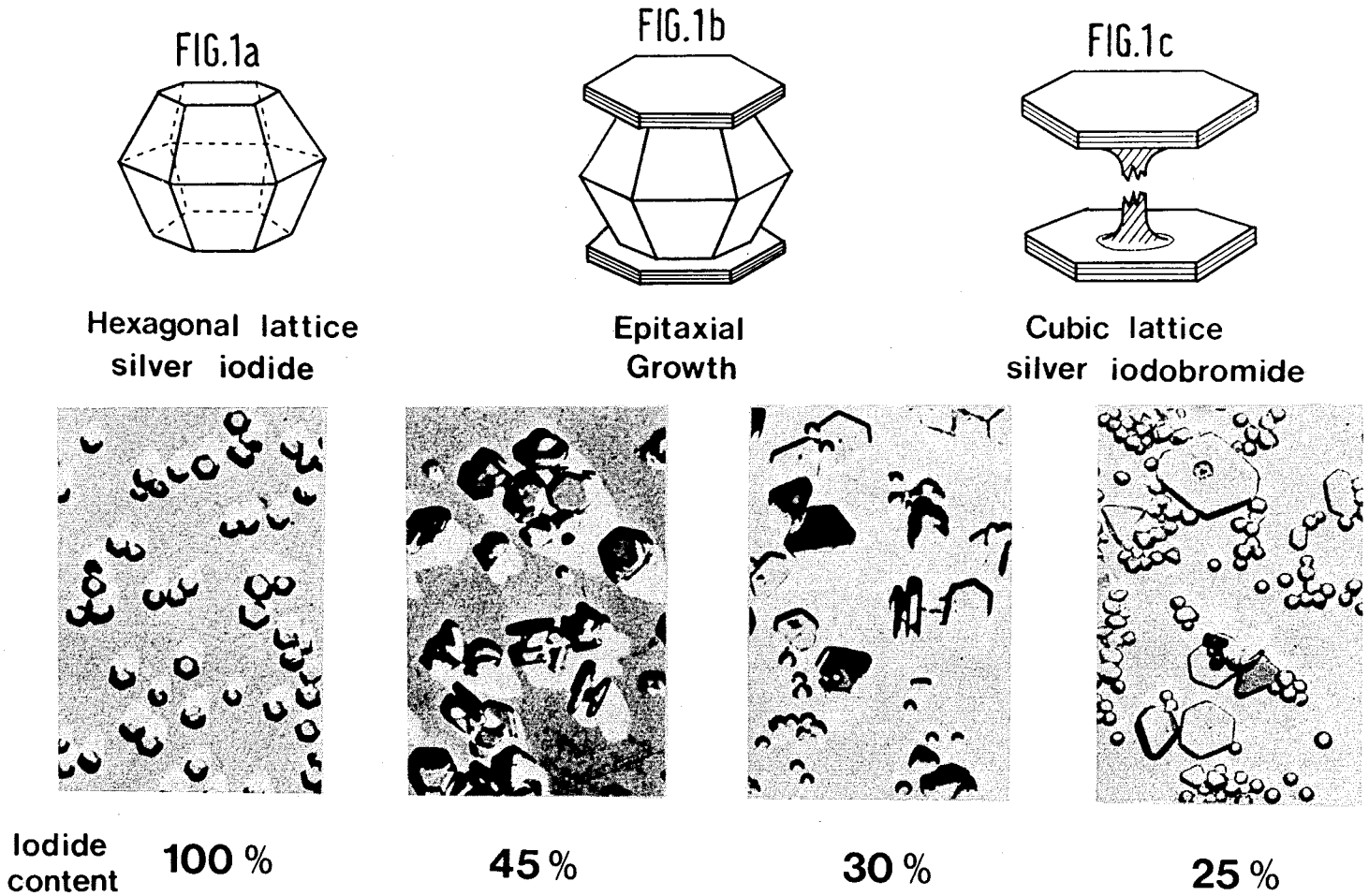

In the process of the present invention, as in the process of the invention of said copending parent application in step (a) silver halide crystals of high iodide content are first formes. Silver halide crystals which have a high iodide content that is to say from 90 100 mole % iodide are predominantly of hexagonal lattice structure. Techniques for the preparation of silver iodide predominantly of hexagonal lattice structure are well-known, and are for example described by B. L. Byerley and H. Hirsch, J. Phot. Sci. vol. 18 p 53 (1970). Such crystals have the shape of hexagonal pyramids or bipyramids. The basal planes of these pyramids comprise the lattice planes (0001). Silver iodide crystals of the hexagonal lattice structure are shown in FIG. 1*a*.

However, silver halide crystals containing smaller amounts of iodide (i.e. up to approximately 45 mole % iodide) are predominantly of the face-centred lattice structure, and have the crystal forms of octahedra (external forms comprising (111) lattice planes). It is known that these crystal shapes may become modified by twinning, so that twinned crystals of the face-centred cubic lattice structure may have the form of triangular or hexagonal plates the form depending on the number and geometry of the twin planes which are formed.

In the process of the present invention in step (b) aqueous solutions of a silver salt and an alkali metal or ammonium bromide or chloride (or mixtures thereof) are added to the dispersion medium containing the silver iodide crystals which are predominantly of the hexagonal lattice structure, so that silver bromide (or chloride or chlorobromide) is precipitated. However, as overall growth of the silver iodide crystals of this structure cannot take place, nuclei of the silver halide being added form as very small crystals of the face-centred cubic lattice type as the proportion of iodide of these crystals is very small. However, during this step the first-formed silver iodide crystals dissolve and silver iodide is incorporated into the growing face-centred cubic lattice crystals. Electron micrographs have revealed that in step (b) whilst no overall circumferential growth of the silver iodide crystals occurs, the face-centred cubic lattice type crystals of the halide being added in step (b) form and grow epitaxially on the basal faces of the silver iodide crystals formed in step (a). Epitaxial growth is possible between (0001) Ag I faces and (111) AgBr or AgCl faces because both are hexagonally close-packed, homoionic lattice planes. It has been observed by electron microscopy that the growing epitaxial crystals show a high degree of twinning (recognised by the parallel striations characteristic of several twin planes intersecting the surface) while attached to the parent silver iodide crystal. It is thought that this twinning is encouraged by the continual supply of iodide ions to the growing (face-centred cubic) phase, either by bulk diffusion through the dispersing medium or by anionic diffusion through the crystal junction. In general, one twinned (fcc) crystal is formed at the single basal face of a hexagonal pyramidal silver iodide crystal, and twinned crystals are formed at each of the two basal faces of the hexagonal bipyramidal silver iodide crystal.

FIG. 1 illustrates schematically and by electron micrographs the recrystallisation of the hexagonal-lattice silver iodide crystals in order to form cubic-lattice silver iodobromide crystals. A hexagonal bipyramidal silver iodide crystal is shown undergoing recrystallisation by the epitaxial growth mechanism. In general, the twinned silver iodobromide crystals form at each basal face of the (truncated) hexagonal bipyramidal silver iodide crystal (a). As step (b) proceeds, and further precipiataion of the silver halide is continued, the iodide proportion of the total halide suspended in the dispersion medium decreases below 30–40 mole % silver iodide. The dissolution of the originally-formed silver iodide crystals becomes predominant, and the "dumbbell"-shaped crystals illustrated in Fig. 1 (b) are observed. During this step the twinned crystals increase in size and the silver iodide crystals decrease in size. Eventually the silver iodide linkage between the two twinned crystals is broken and two twinned crystals are released (1*c*). The residue of the silver iodide may remain on the twinned face-centred cubic lattice crystals, or it may eventually dissolve away. The lower part of FIG. 1 shows electron micrographs (magnification of 30,000X) illustrating the progress of formation of dumbbell crystals and the eventual release of the hexagonal or triangular plate forms characteristic of twinned silver halide crystals. After the Ostwald ripening step (c) has been carried out, the smaller untwinned crystal also produced, and evident in the final electron micrograph, will preferably become dissolved.

A similar process occurs for the recrystallisation of silver iodide to form silver iodochloride or silver iodochlorobromide crystals.

In the process of the present invention, chemically sensitised silver halide crystals of high iodide content are produced in step (a). It has been discovered that during step (b), such crystals become dissolved as twinned crystals are formed, and the products of chemical sensitisation become transferred to the twinned crystals as the iodide becomes incorporated, conferring enhanced photographic sensitivity on the final crystals.

There are four main known methods of chemical sensitisation of silver halide emulsions. These are gold and other noble metal sensitisation; heavy metal sensitisation with the salts of bismuth and lead for example; sulphur and other middle chalcogen sensitisation, and reduction sensitisation. Any one of these methods may be employed in the process of the present invention. Also a combination of these methods may be employed at the same time, for example gold and sulphur sensitisation. This method of sensitisation is illustrated in the preparation of Emulsion A in the Example which follows.

One particularly useful method of sensitising silver halide crystals is to employ Group VIII noble metals. Examples of suitable metal compounds for use in such sensitisation are polyvalent cations, including divalent ions (for example lead), trivalent ions (for example antimony, bismuth, arsenic, gold, iridium and rhodium) and tetravalent ions (for example osmium, iridium and platinum).

Among the noble metal compounds typically employed are compounds such as ammonium and potassium chloropalladate, ammonium, sodium and potassium chloroplatinate, ammonium, potassium and sodium bromoplatinate, ammonium chlororhodate, ammonium chlororuthenate, ammonium chloroiridate, ammonium, potassium and sodium chloroplatinite, ammonium, potassium and sodium chloropalladite, etc. Illustrative gold sensitisers include potassium auriaurite, potassium auricyanide, potassium aurothiocyanate, gold sulphide, gold selenide, gold iodide, potassium chloroaurate, ethylenediamine, bis-gold chloride and various organic gold compounds structurally shown in U.S.-Pat. Specification 3,753,721.

Amongst the compounds used for reduction sensitisation there may be mentioned hydrazine, thiourea and stannous salts.

Both sulphur compounds such as thiosulphate and selenium compounds such as selenosulphate are also used to effect chemical sensitisation.

In the process of the present invention it is to be understood that the twinned crystals formed at the end of step (b) may be relatively very small crystals which are often only of use as seed crystals. These crystals may be grown to usable size during step (d). However, as hereinbefore stated it is possible to have a prolonged step (b) so that at the end of step (b) usable crystals are produced. Nevertheless in the process of this invention steps (b) and (c) may merge into step (d) without any interruption in the addition of the aqueous solutions occurring.

However, in general the twinned crystals formed at the end of step (b) are seed crystals, thus the silver iodide dissolved from the silver iodide crystals formed in step (a) will be present in the seed crystal and thus after the growth step (d) will be present in the core of the crystal unless further iodide is added during step (b). Thus, after the products of chemical sensitisation have been transferred from the chemically-sensitised silver iode formed in step (a), the chemically-sensitised twinned crystals formed in step (b) will increase in size in step (c) the Ostwald ripening step and also in step (d) which is preferably carried out in the process of the present invention and thus these twinned crystals will form the core of the final crystals formed after step (d). Therefore, if for example the silver iodide crystals formed in step (a) are chemically-sensitised by the occlusion of a noble metal e.g. rhodium during step (a) then during step (b) the rhodium will be occluded in the growing twin crystals. Then, after steps (c) and (d) the rhodium will be present as part of the core of the final silver halide crystals. Thus the process of the present invention provides a novel method of chemically sensitising the core of core/shell silver halide emulsions.

There are various advantages of chemically sensitising by use of this process for example the twinned crystals only are sensitised in step (b) and not the other untwinned crystals which are formed in step (b) which would occur if the chemical sensitisation took place in step (b). Also, it is possible to chemically sensitise the silver iodide under chemical conditions which would not be suitable for other silver halides if the chemical sensitisation were carried out during step (b).

The chemical sensitisation of the silver iodide in step (a) can occur at any stage in step (a), e.g. it can occur whilst the silver iodide crystals are being formed or it can occur as the final stage in step (a) after the silver iodide crystals have been fully prepared in this step.

The chemical sensitisation is carried out by adding to the emulsion reactants the various chemical sensitising agents hereinbefore mentioned.

These compounds can either be added continuously during a part of the whole of the crystallisation process in step (a), for example by incorporating them into the feedstock solutions; or alternatively the crystallisation process can be halted, the part-grown crystals treated with the appropriate reagent, and growth recommenced.

A few mole % of other halides, for example, silver bromide or silver chloride may be admixed with the silver iodide crystals precipitated with the silver iodide. This may improve the efficiency of the chemical sensitisation, or the developability of silver iodide emulsions as described by James and Vanselow, Photographic Science and Engineering 5,1 (1961) during tests to monitor the progress of the digestion process.

Many of the agents normally used during chemical sensitisation may be employed; for example stabilisers may be added to effectively terminate the sensitisation (chemical digestion) or the sensitisation may be carried out in the presence of restrainers, such as nucleic acids or cysteine. The chemical conditions may be chosen to achieve satisfactory characteristics. For example, it is preferable to sensitise with sulphur and gold salts at a fixed pAg, for example 8–9 and pH, for example 5–7, and an elevated temperature (50°–60° C.), and in the case of heavy metal sensitisation, using for example, the salts of bismuth or lead, at a relatively low pH, for example 3.

The chemically-sensitised silver iodide emulsions prepared in step (a) may be freed from water-soluble salts or excess sensitising agents by flocculation and washing by any of the known techniques before step (b) is carried out.

Preferably in step (a) pure silver iodide crystals are formed but up to 10 mole % of other halides (chloride or bromide) may be present in the silver iodide crystals while still retaining predominantly their hexagonal lattice form. Thus it is to be understood that the term silver iodide crystals includes crystals containing up to 10 mole % of other halides. It is to be understood that a small fraction of the crystals formed (i.e. up to 10% by weight or number of the crystals) in step (a) may be predominantly silver chloride or silver bromide and of the face-centred cubic lattice type without marked effect on the process according to the invention. Preferably in step (b) no additional iodide is added in the halide solution, but the possibility of adding small amounts is not excluded (i.e. up to 10 mole % of the halide added in this step may be iodide).

It is preferred that the median linear size of the silver iodide crystals formed in step (a) should be in the range 0.05–5.0 microns but most preferably in the range 0.1–1 microns.

It is preferred that the silver iodide content in the dispersing medium at the commencement of step (b) should be in the range 0.05–2.0 moles/liter and most preferably in the range 0.10–1.0 moles/liter.

It is a particular feature of the present invention and of the parent invention that in order to prepare a crystal population of the highest uniformity in step (b) which may be used to prepare monodisperse emulsions, the addition rates of the silver halide solutions added in step (b) should be predetermined by experiment. The optimum flow rates in this respect depend on the nature of the halide, and increase with the number of silver iodide crystals in the aqueous dispersion medium, the crystal size of the silver iodide crystals, the pAg in the range specified above, and the temperature. For example higher rates of addition are required in the preparation of silver iodochloride or silver iodochlorobromide emulsions than in their silver iodobromide equivalents.

It is preferred in the recrystallisation step (b) that the volumes of silver nitrate and ammonium or alkali metal halides added should be such that the silver iodide comprises from 0.01–20 mole % of the total silver halide in the final emulsion. As an indication of the appropriate flow rate the rate should be adjusted until the dissolution of the silver iodide is substanitally complete by the time at which a quantity of silver nitrate one to three times that equivalent to the silver iodide has been added. The optimum rate can thus be deduced from electron micrographs taken at different times during the recrystallisation, as the distinctive crystal habit of the silver iodide crystals allows them to be differentiated from silver halide crystals of the usual face-centred cubic lattice.

It is apparent from the previous discussion of the mechanism of the process according to the present invention that electron micrographs of emulsion samples extracted during experimental preparations in which the addition rate during step (b) is varied can be used to give another indication of the optimal flow rates. It is preferable that a constant flow rate is employed in step (b) and electron micrographs of the final, ripened emulsion at the end of step (c) can be used to select the optimal rate of addition during step (b) which would produce a population of twinned crystals of greatest uniformity and shape. The optimal flow rate during step (b) which is most appropriate for the conditions chosen for the ripening step (c) can thus be determined by prior experiment.

Preferably the addition rates should be so chosen also that no Ostwald ripening among the existing population of twinned crystals should occur. The experimental predeterminations necessary to ensure that the optimal range of flow rates may be employed are similar to those described in British Pat. Spec. No. 1,469,480. An excessively low addition rate in step (b) would lead to incomplete recrystallisation of the silver iodide crystals formed in step (a) and excessive widening of the size distribution of the twinned crystals which are formed, due to Ostwald ripening. An excessively high addition rate in step (b) would lead to a substantial renucleation of untwinned crystals which could be readily detected due to their characteristic regular cubic or octahedral shape. In this case, dissolution of the untwinned crystals during the Ostwald ripening step (c) may be incomplete leading to a wide distribution of iodide content and a bimodal size distribution of the final emulsion. Both effects would lead to a loss of photographic contrast in the final emulsion. A population of twinned crystals more uniform in size and shape results from the selection of an appropriate, intermediate rate of addition during step (b).

It has been found that the silver halide emulsions produced by the process of the parent application have a high internal sensitivity compared with untwinned silver halide emulsions and this is shown in the Example. However, by the process of the present invention it is possible to increase markedly the internal sensitivity of the final silver halide emulsions and this is shown in the Example.

The speed of internally-sensitised emulsions may be increased by adding one or more of reagents commonly used with negative emulsion. In particular, it is possible to spectrally sensitise these emulsions with dyes of the type commonly used with surface-sensitive negative emulsions. It is advantageous in this case to use high surface coverage of dye, such as would cause desensitisation in a surface-sensitised emulsion of the same size, since the internal image is not subject to dye-induced desensitisation.

Imagewise-exposed internally sensitive emulsions can be developed using one of the techniques known in the art to produce an internal image. These mainly involve a developer of standard type with the addition of quantities of either free iodide, or a silver halide solvent such as an alkali thiosulphate. Optionally, the surface can be bleached with an oxidising agent before development, to remove surface image (Sutherns, J. Phot. Sci. 9,217 (1961)).

If the shell silver halide layer is thin (of the order 15 lattice planes) it is possible to develop the crystal in a surface developer; such a technique produces an emulsion yielding a conventional surface image but again avoids the desensitisation resulting from large dye additions to surface-sensitive emulsions.

By using a surface developer containing certain fogging (or nucleating) agents, it is possible to produce a direct-positive image with the internally-sensitive emulsions described above. Nucleating or fogging agents commonly used contain a hydrazine, hydrazono or a heterocyclic ring containing nitrogen, or combinations of these. Suitable hydrazine compounds are referred to in British Patent Spec. No. 702,162, 712,355, 1,269,640 and 1,385,039 and hydrazono compounds in British Patent Spec. No. 1,371,366 (the latter can also act as sensitising dyes) Examples of heterocyclic N-containing systems are given in British Pat. Spec. No. 1,363,772, 1,362,859 and 1,283,835 and U.S. Pat. Spec. No. 3,850,638. In addition to organic fogging agents, inorganic compounds, typically chelated stannous complexes or boron compounds, are sometimes used, for example in French Pat. Specification No. 1,579,422 and U.S. Pat. Spec. No. 3,617,282 and 3,246,987. Fogging may also be achieved by a prebath containing fogging agent, or a fogging agent may be incorporated in the emulsion layer or in a separate layer adjacent to the emulsion layer. Fogging may also be brought about by an uniform light exposure prior to or during processing in a surface developer as described in U.S. Pat. Specification No. 3,796,577.

The process of the present invention can be used to prepare direct positive emulsions, using otherwise known technology as described, for example in British Pat. Spec. No. 723,019, and in the paper by Vanassche et al, J. Phot. Sci. 22, 121 (1974). The silver halide emulsion as prepared by the process of the present invention is fogged using a combination of a reducing agent (thiourea dioxide, hydrazine, tin salts, and several others are known) and a compound of metal more electropositive than silver (gold and/or palladium are preferred). An electrontrapping compound, preferably one which is also a spectral sensitiser for the direct positive process is added. The emulsion, after coating, imagewise exposure, and treatment with a surface developer will yield a direct positive image. The usual additives can be applied to the direct positive emulsion if required; for example, soluble halides to increase speed, sensitising or desensitising dyes to increase spectral range, and blue speed increasing compounds. It is also possible to protect the surface fog from atmospheric oxidation by covering it with a thin silver halide layer, so that it is still accessible to conventional surface developers.

In order to alter the properties of the final silver halide crystals it is possible to alter the halides added during step (b) or to change completely the halides or halide ratios employed from step (b) to step (d). Thus it is possible to obtain layers of particular halide ratio in the final crystals by arranging for a particular halide or mixture of halides to be used at successive stage in step (b) or in step (d) in the process of the present invention.

Where the emulsions prepared by the process of the present invention are to be used for negative working photographic material it is advantageous that after the recrystallisation step (b) and repening step (c) the halides in step (d) are added so that up to 10 mole % iodide is precipitated in a "shell" surrounding the "core" twinned crystals formed in step (b), and that up to 10 mole % chloride is precipitated in the outermost shell of the crystals. Thus silver iodochlorobromide emulsions can be prepared according to the present invention with crystals containing "internal" iodide, (in addition to that derived from the original silver iodide crystals) and "surface" chloride layers.

Where the emulsions prepared by the process of the present invention are to be used for direct positive materials or other applications where internally sensitive crystals are desired, it is advantageous that the halide precipitated during the first part or the whole recrystallisation step (b) should be predominantly chloride, and the halide precipitated during the whole or final part of the growth step (d) should be predominantly bromide. Thus silver iodochlorobromide emulsions can be prepared according to the present invention with crystals containing "internal" chloride and "surface" bromide layers.

Such "core-shell" emulsions are well-known and are also described in British Pat. Spec. No. 1,027,146.

The process of the present invention is of particular use in the preparation of monodisperse emulsions.

Preferably in order to produce monodisperse emulsions using the process of this invention the silver iodide emulsion prepared in step (a) is itself of the monodisperse type. such emulsions may be prepared by the mixing of aqueous solutions of a silver salt and an alkali metal or ammonium iodide in a stirred solution of a protective colloid, at a fixed temperature and pAg. The final crystal size of the silver iodide emulsion is preferably in the range 0.05–5.0 micron. The halide solution is preferably ammonium or potassium iodide alone, but up to approximately 10 mole % of ammonium chloride or bromide may be used. In order that conveniently high rates of addition may be employed, the temperature of the preparation is preferably at least 60° C., and the pAg of the solution is maintained at a controlled value in the range 3–5 or in the range 11–13. Most preferably the pAg is maintained at a value of approximately $11.8 \pm 0.3$. The pAg value may be maintained most conveniently by a suitable electrode system and automatic adjustment to the flow rate of one of the solutions.

As just stated the preferred size range of the silver iodide crystals prepared in step (a) is within the range of 0.05 to 5.0 microns. Also the silver iodide crystals prepared in step (a) may be monodisperse. It has been found that the average size of the silver iodide crystals formed in step (a) influences the size of the twinned crystals formed in step (b). In general the larger the silver iodide crystal formation in step (a) the larger the twinned crystals formed in step (b).

One method of increasing the size of the silver iodide crystals formed in step (a) is to carry out step (a) in the presence of a silver iodide solvent. Also the solubility of the silver iodide may conveniently be controlled by variation of temperature, the quantity of excess iodide and the proportion of silver iodide solvent in the dispersing medium.

It is also evident that the crystal size distribution of the final twinned emulsion depends also on the crystal size distribution of the silver iodide formed in step (a). Thus although it is preferred for high-contrast applications such as X-ray films that the silver iodide crystals in step (a) should be monodisperse, for low-contrast applications such as camera films it may be preferred to prepare a relatively polydisperse twinned silver halide emulsion according to the present process by producing a relatively wide size distribution in the silver iodide crystals prepared in step (a). Alternatively, such a wide size distribution may be produced by blending of monodisperse silver iodide emulsions of different size before the commencement of step (b). Thus the control of size and size distribution of the twinned silver halide crystals produced in steps (b) and (c) or (d) can be achieved by selection of the size and size distribution of the silver iodide crystals formed in step (a). The water-soluble salts formed during the process of the present invention may be removed by any of the well-known methods. Such methods often involve coagulating the silver halide and colloid dispersing agent, removing this coagulation from the then aqueous medium, washing it and redispersing it in water.

As just stated, emulsions prepared according to the present invention may have a predisposition towards latent-image formation in the interior of the crystals, and such emulsions are particularly suitable for use with solvent developers, to form a negative image, as shown in FIG. 2 with reference to the Examples or with fogging developers to form a direct-positive image, as shown in FIG. 3. However, by appropriate surface chemical sensitisation in the optional step (e) of the present process, using any of the means described above, emulsions may be provided with a much greater tendency to form surface latent-image on exposure which would then be revealed by a negative-working developer of the standard type. Depending on the respective type or extent of the chemical sensitisation processes employed in the step (a) and step (e), the balance between formation of latent-image in the interior and exterior of the crystal can be precisely controlled. For example, the chemical sensitisation carried out in step (a) could be achieved by the addition of rhodium or iridium salts at the appropriate level, and the chemical sensitisation, step (e), of the surface of the crystals could be achieved by a prolonged digestion with sulphur and gold salts. Such a process would be particularly suitable for emulsions prepared according to the present invention and which contained predominantly silver chloride, providing emulsions which produce a negative image in a standard negative-working developer but of enhanced contrast compared with a similar emulsion in which the sensitisation in step (a) was omitted. Many other combinations of such internal and surface sensitisation processes will be obvious to those skilled in the art.

It is also obvious that the photographic contrast could be controlled by blending two or more emulsions prepared according to the present process but which are chemically sensitised to different extents or by different methods during either steps (a) or (e).

The emulsions prepared by the process of the present invention may be optically sensitised by the addition of optical sensitisers for example carbocyanine and merocyanine dyes to the emulsions.

The emulsions may contain any of the additives commonly used in photographic emulsions for example wetting agents, such as polyalkalene oxides, stabilising agents such as tetraazaindenes, metal sequestering agents and growth or crystal habit modifying agents commonly used for silver halide such as adenine.

Preferably the dispersing medium is gelatin or a mixture of gelatin and a water-soluble latex for example a latex vinyl acrylate-containing polymer. Most preferably if such a latex is present in the final emulsion it is added after all crystal growth has occurred. However, other water-soluble colloids for example casein, polyvinyl-pyrrolidone or polyvinyl alcohol may be used alone or together with gelatin.

The silver halide emulsions prepared according to the process of the present invention may exhibit a desirably high covering power and speed on development as shown in the Example which follows.

The silver halide emulsions prepared according to the present invention thus are of use in many types of photographic materials such as X-ray films, camera films both black and white and colour, paper products and direct positive materials.

Thus the invention includes silver halide emulsions prepared by the process of the present invention and coated photographic silver halide material containing at least one such emulsion.

EXAMPLE

The following emulsions were prepared

EMULSION A

This example illustrates the preparation of a monodisperse twinned octahedral emulsion according to the present invention, in which internally-sensitive twinned crystals are produced by the recrystallisation of silver iodide crystals, which have been chemically sensitised by heat treatment with sulphur and gold salts and used to produce a direct positive image by suitable processing.

Preparation of monodisperse silver iodide emulsion (step a)

1 liter of a 5% aqueous solution of an inert gelatin was stirred at 65° C. at 200 rpm with 2 ml of n-octanol as an antifoam. Aqueous 4.7 M solutions of silver nitrate and potassium iodide were jetted into the stirred gelatin solution at 3000 ml per hour until 150 ml of silver nitrate solution had been added. The pAg was maintained at a value of 11.8 during precipitation.

The growth of the silver iodide crystals was interrupted at this stage and chemical sensitisation was carried out by digesting the emulsion at 57° C. for 100 minutes at pH 6.3 and pAg 8.8 in the presence of 14 mg of sodium thiosulphate and 2.4 mg of sodium tetrachloroaurate dihydrate per mole of silver halide.

Precipitation was then resumed, further volumes of 4.7 M silver nitrate and potassium iodide solutions being added at 2100 ml per hour until 525 ml of silver nitrate solution had been added. Again, the pAg was maintained at a value of 11.8. The crystals of this silver iodide emulsion had a median size of 0.18 micron.

Recrystallisation and ripening (steps b and c)

230 g of the silver iodide emulsion prepared in step (a) were added to 1 liter of a 5% aqueous solution of an inert gelatin, which was stirred at 200 rpm at 65° C. with 2 ml of n-octanol and 30 ml of 5 N sulphuric acid. Aqueous 4.7 M solutions of silver nitrate and ammonium bromide were jetted into the stirred silver iodide emulsion at a rate of 3000 ml per hour until 500 ml of silver nitrate had been added. The pAg was maintained throughout at 7.7±0.3.

Ostwald ripening was effected by the presence of 100 ml of 11.8 M ammonia solution, added with the halide solution so that as recrystallisation occurred, the concentration of ammonia increased. At the end of the addition of silver nitrate and ammonium halide solutions, dissolution of untwinned crystals by Ostwald ripening was substantially complete, and predominantly twinned crystals of silver iodobromide remained.

Further growth (step d)

The pH of the emulsion prepared in step (c) was adjusted to 5.0 with 5 N sulphuric acid so that the ammonia present was neutralised. Futher 4.7 M solutions of silver nitrate and ammonium bromide were added to the emulsion stirred at 200 rpm, with the temperature maintained at 65° C. and the pAg at 9.5, at a flow rate of 3000 ml per hour until 750 ml of silver nitrate solution had been added. The final emulsion had a median crystal size of 0.76 micron, and a coefficient of variation of 16%. The emulsion was flocculated using conventional techniques, washed and redispersed with a total of 210 g of limied ossein gelatin. No further chemical sensitisation was carried out in this case i.e. the optional step (e) was omitted. The emulsion was adjusted to pH 6.3 and pAg 8.8 and coated on to photobase at a coating weight of 50 mg Ag/dm$^2$.

EMULSION B

This example illustrates the preparation of a monodisperse twinned silver iodochlorobromide emulsion according to the present invention, which comprises twinned crystals with a "core" of silver iodochloride and an outer "shell" of silver bromide, and which is produced by the recrystallisation of silver iodide crystals which have been chemically sensitised by the addition of a rhodium salt during precipitation.

Preparation of monodisperse silver iodide emulsion (step a)

A monodisperse silver iodide emulsion was prepared exactly according to the method given in step (a) of Example 1, except that the digestion with the sulphur and gold salts was omitted.

Instead, after completion of the growth of the silver iodide crystals to 0.18 micron median size, 35 of an aqueous solution containing $35\times10^{-4}$ g of sodium hexachlororhodite dissolved in 10 N lithium chloride was added to the silver iodide emulsion in order to incorporate rhodium into the surface layers of the silver iodide crystals, most probably in the form of adsorbed rhodium complex ion species. The emulsion was stirred for 15 minutes at 65° C. to allow adsorption, and chemical sensitisation, to occur.

Recrystallisation and ripening (steps b and c)

230 g of silver iodide emulsion prepared in step (a) were added to 1 liter of a 5% aqueous solution of an inert gelatin, which was stirred at 200 rpm at 65° C. with 2 ml of n-octanol and 30 ml of 5 N sulphuric acid. Aqueous 4.7 M solutions of silver nitrate and ammonium chloride were jetted into the stirred silver iodide emulsion at a rate of 3500 ml per hour until 75 ml of silver nitrate solution had been added. The pAg was maintained at 7.3±0.2 throughout. Aqueous 4.7 M solutions of silver nitrate and ammonium bromide were jetted into the stirred emulsion at a rate of 3000 ml per hour until a further 425 ml of silver nitrate solution had been added. The pAg was maintained at a value of 7.7±0.2 during this stage of the precipitation.

Ostwald ripening was effected by the presence of 100 ml of 11.8 M ammonia solution, added with the halide solutions during this step, so that as recrystallisation of the chemically-sensitised silver iodide crystals occurred, the concentration of ammonia increased. At the end of the addition of silver nitrate and ammonium halide solutions, dissolution of untwinned crystals by Ostwald ripening was substantially complete, and predominantly twinned crystals of silver iodochlorobromide remained. The crystal size and habit were similar to Emulsion A.

Further growth (step d)

Further growth of this emulsion was carried out exactly as described in step (d) of the preparation of Emulsion A and prepared for coating on to photobase at a coating weight of 50 mg Ag/dm$^2$ as previously described.

EMULSION C

For comparison, an emulsion was prepared by a process according to the parent copending application Ser. No. 799,040, filed May 20, 1977, now U.S. Pat. No. 4,150,994, in which the high internal sensitivity of the emulsion as prepared is exploited to produce a direct positive image, for comparison with that produced from Emulsion A.

A monodisperse twinned octahedral emulsion was prepared exactly as described for Emulsion A except that the chemical sensitisation of the silver iodide emulsion with the sulphur and gold salts described in step (a) of Example A was omitted.

EMULSION D

An untwinned monodisperse cubic silver bromide emulsion of 0.39 micron average edgelength, was prepared as a reference. The cubic monodisperse emulsion was prepared by the pAg-controlled techniques described in British Pat. No. 1,335,925, except that, in order to obtain a satisfactory reversal characteristic, internal and surface chemical sensitisation were carried out. The preparation of this emulsion had the following stages:

(i) Growth of crystals to 0.12 micron average edgelength.
(ii) Digestion at pH 6.3 and pAg 7.8 and at 70° C. for 40 minutes with 14 mg of sodium thiosulphate and 0.6 mg of sodium tetrachloroaurate dihydrate per mole of silver halide.
(iii) Further growth of cubic crystals to 0.39 micron average edgelength.
(iv) Further digestion at pH 6.3 and pAg 8.8 and at 57° C. for 40 minutes with 12.5 mg of sodium thiosulphate and 1.8 mg of sodium tetrachloroaurate dihydrate per mole of silver halide.

The reference emulsion was then coated on to photobase at a coating weight of 30 mg Ag$^2$/dm. If the digestion of stage (ii) were omitted, a constant densit- (D max) was obtained with no reversal. If the surface sensitisation of stage (iv) were omitted, a very low maximum density (D max) was observed.

Photographic results

The coated strips were then imagewise exposed for 0.2 seconds with a tungsten source of intensity 1000 Lux on an intensity scale sensitometer.

In order to assess the internal sensitivity of the emulsions the coated samples were processed for 4 minutes at 20° C. in an internal (solvent) developer of the following composition:

| DEVELOPER I | |
|---|---|
| Methyl-p-aminophenol sulphate | 0.7 g |
| Hydroquinone | 2.7 g |

-continued

| DEVELOPER I | |
|---|---|
| Sodium sulphite (anhydrous) | 25 g |
| Sodium carbonate | 12.5 g |
| Sodium thiosulphate | 10 g |
| Potassium bromide | 0.7 g. |
| Water to 1 liter | |

followed by fixation, washing and drying in the conventional manner. The photographic results obtained are shown in FIG. 2.

All emulsions had been spectrally sensitised by the addition of 0.2 mg of the cyanine dye anhydro-[3-(3-sulphopropyl)-2-benzothiazole] (3-ethyl-2-benzothiazole) β-methyltrimethincyanine hydroxide per mole of silver halide before coating. To obtain a direct-positive image the coated samples were processed for 8 minutes at 20° C. in a fogging developer of the following compoisition:

| DEVELOPER II | |
|---|---|
| 1-phenyl-3-pyrazolidone | 0.25 g |
| Hydroquinone | 10 g |
| Sodium sulphite (anhydrous) | 25 g |
| Sodium carbonate | 12.5 g |
| Sodium hydroxide | 10 g |
| Potassium bromide | 0.7 g |
| 5-methylbenzotriazole | 50 mg |
| N-formyl-N'-p-tolylhydrazine | 50 mg |
| water to 1 liter | |

followed by fixation, washing and drying in the conventional manner. The photographic results obtained are shown in FIG. 3.

Discussion of photographic results

The photographic results shown in FIGS. 2 and 3 illustrate the improved photographic behaviour of emulsions prepared according to the present invention.

The results obtained for internal development of the coated strips are shown in the usual form of developed density-log exposure curves in FIG. 2. These demonstrate the enhanced internal sensitivity resulting from the chemical sensitisation carried out in step (a) of the novel process according to the present invention in the case of emulsions A and B, compared with that Emulsion C which was prepared by a process according to the parent application. Similar results were obtained if the coated strips were pre-treated with a ferricyanide bleach to remove any surface image as described by Sutherns, J. Phot. Sci. 9,217 (1961). It is also evident that the twinned emulsions prepared by either process had considerably greater internal sensitivity than the reference emulsion D, which was an untwinned cubic silver bromide emulsion.

FIG. 3 shows the photographic results obtained by fogging development of the coated strips. These illustrate that the greater internal sensitivity of emulsions A and B result in a corresponding improvement in direct reversal characteristics compared with emulsions C and D. The photographic speeds measured from the coated strips after processing in the fogging developer II (where a direct positive image was obtained) were similar in value to the internal speeds measured after processing in the solvent developer I. It is evident from FIG. 3 that excellent reversal characteristics may be obtained for the twinned emulsions of the present invention without the surface chemical sensitisation treatment which is necessary for the untwinned reference emulsion D.

I claim:

1. A method of preparing a silver halide emulsion of the twinned type which comprises the steps of (a) forming in a colloid dispersing medium silver halide crystals containing at least 90 mole % iodide, these said crystals being predominantly of the hexagonal lattice structure and then chemically sensitising the said silver halide crystals which contain at least 90 mole % iodide, (b) mixing in the dispersing medium containing the said silver halide crystals an aqueous solution of a silver salt and an aqueous solution of an alkali metal or ammonium bromide or chloride or mixtures thereof so forming twinned silver halide crystals containing iodide and the halide or halides being added, (c) adding a silver halide solvent to the dispersing medium and so causing the growth of the twinned crystals by Ostwald ripening, optionally (d) causing the twinned crystals to increase in size by adding to the colloidal dispersion further aqueous silver salt solution and further alkali metal or ammonium halide and then finally optionally (e) removing the water-soluble salts formed and chemically sensitising the surface of the silver halide crystals of the emulsion.

2. A method according to claim 1 wherein the chemical sensitisation in step (a) is gold or another noble metal sensitisation.

3. A method according to claim 2 wherein the other noble metal is platinum, iridium or rhodium.

4. A method according to claim 1 wherein the chemical sensitisation in step (a) is effected by a compound of a heavy metal.

5. A method according to claim 4 wherein the heavy metal compound is a salt of lead or bismuth.

6. A method according to claim 1 wherein the chemical sensitisation in step (a) is sulphur or selenium sensitisation.

7. A method according to claim 1 wherein the chemical sensitisation in step (a) is reduction sensitisation.

8. A method according to claim 7 wherein the reducing agent used is a stannous salt, thiourea, a hydrazine or formaldehyde.

9. A method according to claim 1 wherein two types of chemical sensitisation are carried out in step (a).

10. A method according to claim 9 wherein the two types of chemical sensitisation are gold and sulphur sensitisation.

11. A method according to either claim 2 or claim 6 wherein the sensitisation is carried out at a fixed pAg between 8 and 9 and at a fixed pH between 5 and 7 at an elevated temperature between 50° C. and 60° C.

12. A method according to claim 5 wherein the sensitisation is carried out at a pH of approximately 3.

13. A method according to claim 1 wherein step (d) is carried out and the silver halide crystals formed in step (b) constitute the core of final silver halide crystals and the halide added in step (d) constitutes the shell of the final silver halide crystals.

14. A method according to claim 1 where in step (b) the halide precipitated during at least the first part of the step is predominantly chloride and in step (d) the halide precipitated at least during the final part of the step is predominantly bromide.

15. A method according to claim 1 wherein the surface of the silver halide crystals are chemically sensitised in step (e).

16. A method according to claim 15 wherein the chemical sensitisation is sulphur and gold sensitisation.

17. A method according to claim 1 wherein the surface of the silver halide crystals is fogged in step (e).

18. A method according to claim 17 wherein the fogging is carried out by use of a reducing agent together with a compound of a metal more electro-positive than silver.

19. A method according to claim 18 wherein an electron-trapping compound is adsorbed on the surface of the silver halide crystals.

20. A silver halide emulsion when prepared according to claim 1.

21. Photographic material which contains at least one layer which contains a silver halide emulsion according to claim 20.

* * * * *